US009074476B2

(12) United States Patent
Hardy

(10) Patent No.: US 9,074,476 B2
(45) Date of Patent: Jul. 7, 2015

(54) NICKEL ALLOY

(75) Inventor: Mark Christopher Hardy, Belper (GB)

(73) Assignee: ROLLS-ROYCE plc, London (GB)

( * ) Notice: Subject to any disclaimer, the term of this patent is extended or adjusted under 35 U.S.C. 154(b) by 434 days.

(21) Appl. No.: 13/566,490

(22) Filed: Aug. 3, 2012

(65) Prior Publication Data

US 2013/0052077 A1 Feb. 28, 2013

(30) Foreign Application Priority Data

Aug. 24, 2011 (GB) ..... 1114606.5

(51) Int. Cl.

| | |
|---|---|
| ***C22C 19/05*** | (2006.01) |
| ***F01D 5/02*** | (2006.01) |
| ***F01D 25/00*** | (2006.01) |
| ***C22F 1/10*** | (2006.01) |
| *C22C 1/04* | (2006.01) |

(52) U.S. Cl.

CPC ..... *F01D 5/02* (2013.01); *C22C 1/0433* (2013.01); *C22C 19/056* (2013.01); *F01D 25/005* (2013.01); *B22F 2998/10* (2013.01); *C22F 1/10* (2013.01)

(58) Field of Classification Search

CPC ..... C22C 19/056; F01D 5/02
USPC ..... 420/443, 445–448; 148/428
See application file for complete search history.

(56) References Cited

U.S. PATENT DOCUMENTS 3,512,963 A * 5/1970 Bieber et al. ..... 420/443
2003/0213536 A1 11/2003 Cao

FOREIGN PATENT DOCUMENTS

EP 2 256 222 A1 12/2010

OTHER PUBLICATIONS

European Search Report issued in European Application No. 12 17 9226 dated Dec. 11, 2012.

* cited by examiner

*Primary Examiner* — Jessee Roe
(74) *Attorney, Agent, or Firm* — Oliff PLC

(57) ABSTRACT

A nickel-base alloy having the following composition (in weight percent unless otherwise stated): Cr 13.7-17.5; Co 2.5-5.6; Fe 8.0-9.3; Si 0-0.6; Mn 0-0.95; Mo 0.5-2.3; W 2.7-3.0; Al 2.2-3.5; Nb 2.7-7.2; Ti 0-0.85; Ta 0-3.25; Hf 0.0-0.5; C 0.01-0.05; B 0.02-0.04; Zr 0.04-0.06; Mg 0.015-0.025; S<50 ppm; P<50 ppm; the balance being Ni and incidental impurities. The alloy has an improved combination of properties (principally resistance to surface environmental damage and dwell fatigue crack growth) compared with known alloys, and is intended to operate for prolonged periods of time above 700° C., and up to peak temperatures of 800° C.

6 Claims, 7 Drawing Sheets

NICKEL ALLOY

BACKGROUND

This invention relates to nickel base alloys, and particularly, though not exclusively, to alloys suitable for use in compressor and turbine discs of gas turbine engines. Such discs are critical components of gas turbine engines, and failure of such a component in operation is usually catastrophic.

There is a continuing need for improved alloys to enable disc rotors in gas turbine engines, such as those in the high pressure (HP) compressor and turbine, to operate at higher compressor outlet temperatures and faster shaft speeds. In addition, high climb ratings are increasingly required by commercial airlines to move aircraft more quickly to altitude to reduce fuel burn and to clear the busy air spaces around airports, which means that the time the engines must spend at maximum power is significantly increased. These operating conditions give rise to fatigue cycles with long dwell periods at elevated temperatures, in which oxidation and time dependent deformation significantly influence the resistance to low cycle fatigue. As a result, there is a need to improve the resistance of alloys to surface environmental damage and dwell fatigue crack growth, and to increase proof strength, without compromising their other mechanical and physical properties or increasing their density.

Known alloys cannot provide the balance of properties needed for such operating conditions, in particular damage tolerance performance under dwell cycles at temperatures in the range of 600° C. to 800° C., resistance to environmental damage, microstructural stability and high levels of proof strength. As such, they are not good candidates for disc applications at peak temperatures of 750° C. to 800° C., because component lives would be unacceptably low.

Some known nickel base alloys have compromised resistance to surface environmental degradation (oxidation and Type II hot corrosion) in order to achieve improved high temperature strength and resistance to creep strain accumulation, and in order to achieve stable bulk material microstructures (to prevent the precipitation of detrimental topologically close-packed phases).

Turbine discs are commonly exposed to temperatures above 650° C., and in future engine designs will be exposed to temperatures above 700° C. As disc temperatures continue to increase, oxidation and hot corrosion damage will begin to limit disc life. There is therefore a need, in the design of future disc alloys, to prioritise resistance to oxidation and hot corrosion ahead of other properties.

Without suitable alloys, environmental protection will need to be applied to discs, which is undesirable and technically very difficult.

SUMMARY

It is an aim of the invention to provide a nickel base alloy that can operate for prolonged periods of time above 700° C., and up to peak temperatures of 800° C.

The invention provides a nickel base alloy as set out in the claims.

BRIEF DESCRIPTION OF THE DRAWINGS

The invention will be more fully described, by way of example only, with reference to the accompanying drawings in which:

FIGS. 2 and 6 are taken from P. M. Mignanelli, (2012), Ph.D. Project, University of Cambridge.

DETAILED DESCRIPTION OF THE EMBODIMENTS

Figure 1:
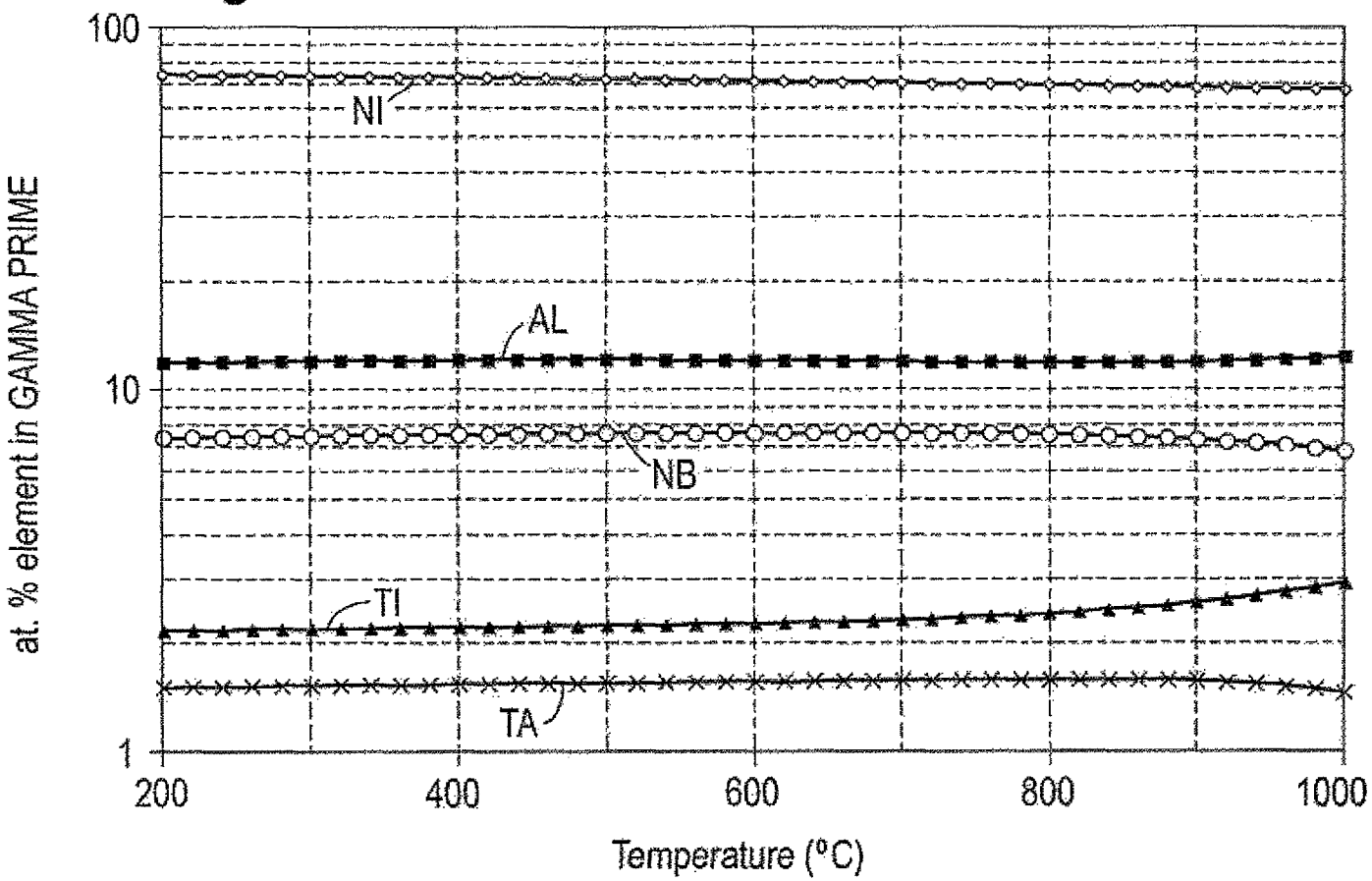
FIG. 1 shows the predicted elemental content in the gamma prime phase for the example alloy V207K.

In defining the compositions of alloys according to the invention, the aim was to produce alloys in which the disordered face-centred cubic gamma (γ) phase is precipitation strengthened by the ordered $L1_2$ gamma prime (γ) phase.

The inventor has determined that the following composition strategy produces the required balance between high temperature proof strength, resistance to fatigue damage and creep strain accumulation, damage tolerance and oxidation/hot corrosion damage.

Twelve example alloys according to the invention have been produced and will be described in detail in due course; details of their compositions are listed in Table 2(i) by atomic percent (at. %), and in Table 2(ii) by weight percent (wt. %).

TABLE 2(i)

| | atomic percent | | | | | | | | | | | | | | | | | |
|---|---|---|---|---|---|---|---|---|---|---|---|---|---|---|---|---|---|---|
| Alloy | Ni | Cr | Co | Fe | Si | Mn | Mo | W | Al | Nb | Ti | Ta | C | B | Zr | Mg | S | P |
| V207G | Bal | 16 | 4 | 9 | 1.15 | 0 | 1.35 | 0.9 | 5 | 3.5 | 1 | 0.7 | 0.15 | 0.15 | 0.035 | 0.05 | <5 ppm | <10 ppm |
| V207H | Bal | 16 | 4 | 9 | 1.15 | 0 | 1.35 | 0.9 | 5.75 | 3.5 | 0 | 1 | 0.15 | 0.15 | 0.035 | 0.05 | <5 ppm | <10 ppm |
| V207I | Bal | 16 | 4 | 9 | 0 | 1 | 1.35 | 0.9 | 6.25 | 3.5 | 0 | 1 | 0.15 | 0.15 | 0.035 | 0.05 | <5 ppm | <10 ppm |
| V207J | Bal | 16 | 4 | 9 | 0 | 1 | 1.35 | 0.9 | 5.5 | 3.5 | 1 | 0.7 | 0.15 | 0.15 | 0.035 | 0.05 | <5 ppm | <10 ppm |
| V207K | Bal | 16 | 5 | 9 | 0 | 0 | 1.35 | 0.9 | 5.5 | 3.5 | 1 | 0.7 | 0.15 | 0.15 | 0.035 | 0.05 | <5 ppm | <10 ppm |
| V207L | Bal | 16 | 4 | 9 | 0 | 0 | 1.35 | 0.9 | 5.5 | 4.5 | 1 | 0 | 0.15 | 0.15 | 0.035 | 0.05 | <5 ppm | <10 ppm |
| V207M | Bal | 19 | 3 | 9 | 0 | 0 | 0.35 | 0.9 | 5.5 | 3.5 | 1 | 0.7 | 0.15 | 0.15 | 0.035 | 0.05 | <5 ppm | <10 ppm |
| V207N | Bal | 19 | 4 | 9 | 0 | 0 | 0.35 | 0.9 | 7.25 | 1.75 | 1 | 0.7 | 0.15 | 0.15 | 0.035 | 0.05 | <5 ppm | <10 ppm |
| V207O | Bal | 18.5 | 3 | 9 | 1.15 | 0 | 0.35 | 0.9 | 5 | 3.5 | 1 | 0.7 | 0.15 | 0.15 | 0.035 | 0.05 | <5 ppm | <10 ppm |
| V207P | Bal | 18.75 | 3 | 9 | 0 | 1 | 0.35 | 0.9 | 5.5 | 3.5 | 1 | 0.7 | 0.15 | 0.15 | 0.035 | 0.05 | <5 ppm | <10 ppm |
| V207Q | Bal | 19 | 3 | 9 | 1.15 | 0 | 0.35 | 0.9 | 7 | 1.75 | 1 | 0.7 | 0.15 | 0.15 | 0.035 | 0.05 | <5 ppm | <10 ppm |
| V207R | Bal | 19 | 3 | 9 | 0 | 1 | 0.35 | 0.9 | 7.25 | 1.75 | 1 | 0.7 | 0.15 | 0.15 | 0.035 | 0.05 | <5 ppm | <10 ppm |

TABLE 2 (ii)

| | weight percent | | | | | | | | | | | | | | | | | |
|---|---|---|---|---|---|---|---|---|---|---|---|---|---|---|---|---|---|---|
| Alloy | Ni | Cr | Co | Fe | Si | Mn | Mo | W | Al | Nb | Ti | Ta | C | B | Zr | Mg | S | P |
| V207G | Bal | 14.12 | 4 | 8.53 | 0.55 | 0 | 2.2 | 2.81 | 2.29 | 5.52 | 0.81 | 2.15 | 0.031 | 0.028 | 0.054 | 0.02 | <5 ppm | <10 ppm |
| V207H | Bal | 14.4 | 4.08 | 8.7 | 0.56 | 0 | 2.24 | 2.86 | 2.69 | 5.63 | 0 | 3.13 | 0.031 | 0.028 | 0.055 | 0.02 | <5 ppm | <10 ppm |
| V207I | Bal | 14.04 | 3.98 | 8.48 | 0 | 0.93 | 2.19 | 2.79 | 2.85 | 5.49 | 0 | 3.05 | 0.03 | 0.027 | 0.054 | 0.02 | <5 ppm | <10 ppm |
| V207J | Bal | 14.1 | 3.99 | 8.52 | 0 | 0.93 | 2.19 | 2.8 | 2.51 | 5.51 | 0.81 | 2.15 | 0.031 | 0.027 | 0.054 | 0.02 | <5 ppm | <10 ppm |
| V207K | Bal | 14.09 | 4.99 | 8.51 | 0 | 0 | 2.19 | 2.8 | 2.51 | 5.51 | 0.81 | 2.14 | 0.031 | 0.027 | 0.054 | 0.02 | <5 ppm | <10 ppm |
| V207L | Bal | 14.21 | 4.03 | 8.59 | 0 | 0 | 2.21 | 2.83 | 2.53 | 7.14 | 0.82 | 0 | 0.031 | 0.027 | 0.054 | 0.02 | <5 ppm | <10 ppm |
| V207M | Bal | 16.89 | 3.02 | 8.59 | 0 | 0 | 0.57 | 2.83 | 2.54 | 5.56 | 0.82 | 2.17 | 0.031 | 0.028 | 0.055 | 0.02 | <5 ppm | <10 ppm |
| V207N | Bal | 17.23 | 4.11 | 8.77 | 0 | 0 | 0.59 | 2.89 | 3.41 | 2.84 | 0.83 | 2.21 | 0.031 | 0.028 | 0.056 | 0.02 | <5 ppm | <10 ppm |
| V207O | Bal | 16.49 | 3.03 | 8.62 | 0.55 | 0 | 0.58 | 2.84 | 2.31 | 5.58 | 0.82 | 2.17 | 0.031 | 0.028 | 0.055 | 0.02 | <5 ppm | <10 ppm |
| V207P | Bal | 16.68 | 3.02 | 8.6 | 0 | 0.94 | 0.57 | 2.83 | 2.54 | 5.56 | 0.82 | 2.17 | 0.031 | 0.028 | 0.055 | 0.02 | <5 ppm | <10 ppm |
| V207Q | Bal | 17.32 | 3.1 | 8.81 | 0.57 | 0 | 0.59 | 2.9 | 3.31 | 2.85 | 0.84 | 2.22 | 0.032 | 0.028 | 0.056 | 0.02 | <5 ppm | <10 ppm |
| V207R | Bal | 17.24 | 3.09 | 8.77 | 0 | 0.96 | 0.59 | 2.89 | 3.41 | 2.84 | 0.84 | 2.21 | 0.031 | 0.028 | 0.056 | 0.02 | <5 ppm | <10 ppm |

The twelve example alloys may conveniently be divided into six groups, in which the compositions are given in weight percent:

Group 1, nominally 5.5 Nb, 14 Cr, 0.55 Si (alloys G and H)

Group 2, nominally 5.5 Nb, 14 Cr, 0.9 Mn (alloys I and J)

Group 3, nominally 5.5 Nb, 14 Cr (alloy K)

Group 4, nominally 7.1 Nb, 14 Cr (alloy L)

Group 5, nominally 5.5 Nb, 16.7 Cr (alloys M, O and P)

Group 6, nominally 2.8 Nb, 17.2 Cr (alloy N, Q and R)

To achieve the required proof strength and resistance to creep strain accumulation, at least 40 mole % of fine (average size around 50 nm) γ' particles ($Ni_3X$, where X is Al, Nb, Ti or Ta) should be precipitated at 800° C. FIG. 1 shows the predicted elemental content in the gamma prime phase for alloy V207K. A high volume fraction of small gamma prime precipitates will effectively hinder the movement of dislocations and will give rise to good high temperature proof strength. Ideally, an average gamma prime particle size of around 50 nm should be developed after quenching the alloy from the solution heat treatment temperature and precipitation (ageing) heat treatment.

Figure 2:
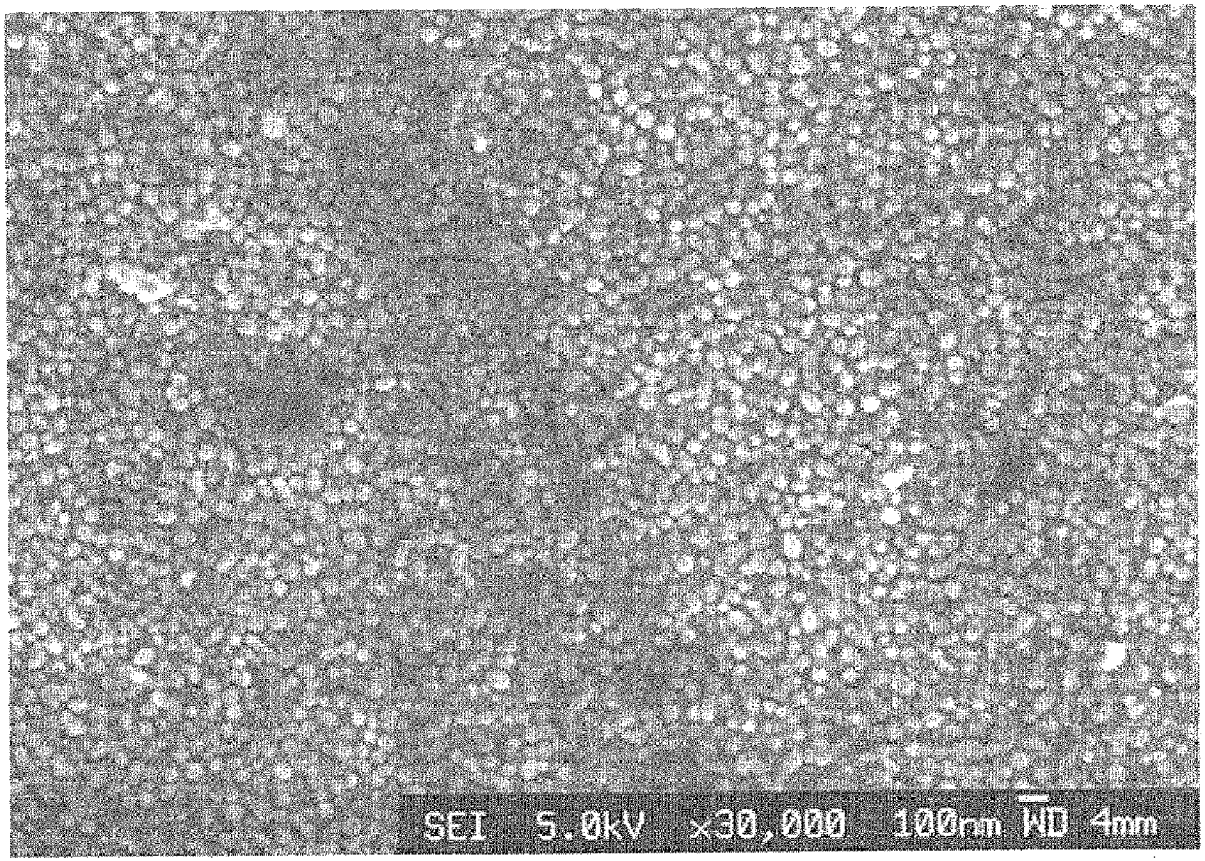
FIG. 2 shows a secondary electron micrograph of forged V207M.

The solidus and gamma prime solvus temperatures have been reduced by adding high levels of Nb, Cr and Fe, and by limiting the levels of Al and Ti. Si is also considered to reduce the gamma prime solvus temperature. A low gamma prime solvus temperature minimises gamma prime size following quenching from temperatures above the gamma prime solvus temperature. Table 3 shows predicted values of the mole % gamma prime level at 800° C. and the gamma prime solvus temperature for the example alloys according to the invention, compared with the two known alloys 720Li and RR1000. Experimental work has shown that the actual proportion of gamma prime may be higher than these predicted values, perhaps as high as 50% at room temperature. To illustrate this, FIG. 2 shows a secondary electron micrograph of forged V207M after solution and precipitation heat treatments. The solution heat treatment temperature was sufficiently high to avoid the meta-stable eta-like phase. The sample was electrolytically etched with 10% phosphoric acid to remove the gamma phase.

TABLE 3

| | Predicted values from JMat Pro | |
|---|---|---|
| Alloy | % γ' at 800° C. | γ' solvus (° C.) |
| V207G | 38 | 1024 |
| V207H | 37 | 1019 |
| V207I | 39 | 1031 |

TABLE 3-continued

| | Predicted values from JMat Pro | |
|---|---|---|
| Alloy | % γ' at 800° C. | γ' solvus (° C.) |
| V207J | 39 | 1039 |
| V207K | 39 | 1050 |
| V207L | 40 | 1048 |
| V207M | 40 | 1046 |
| V207N | 39 | 1079 |
| V207O | 39 | 1026 |
| V207P | 40 | 1038 |
| V207Q | 40 | 1061 |
| V207R | 39 | 1066 |
| 720Li | 44 | 1159 |
| RR1000 | 42 | 1148 |

Note that i) primary gamma accounts for 10-15% of gamma prime in RR1000 and 15-20% of gamma prime in 720Li when these alloys are given a sub-solvus heat treatment, and ii) primary gamma prime particles have a small contribution to proof strength and resistance to creep strain; the size and volume fraction of intragranular secondary and tertiary gamma prime primarily determine these properties, although grain size also has a significant effect on proof strength. In these alloys, the average size of the secondary and tertiary gamma prime particles is typically 100 nm and 10-20 nm for 720Li, and 200 nm and 10-20 nm for RR1000, respectively.

The addition of Nb and Ta is important as these elements show slow rates of diffusion, which is significant during high temperature (650-800° C.) exposure of the alloy in air as Al and Ti in the prior art migrate from gamma prime to form oxidation products.

Figure 3:
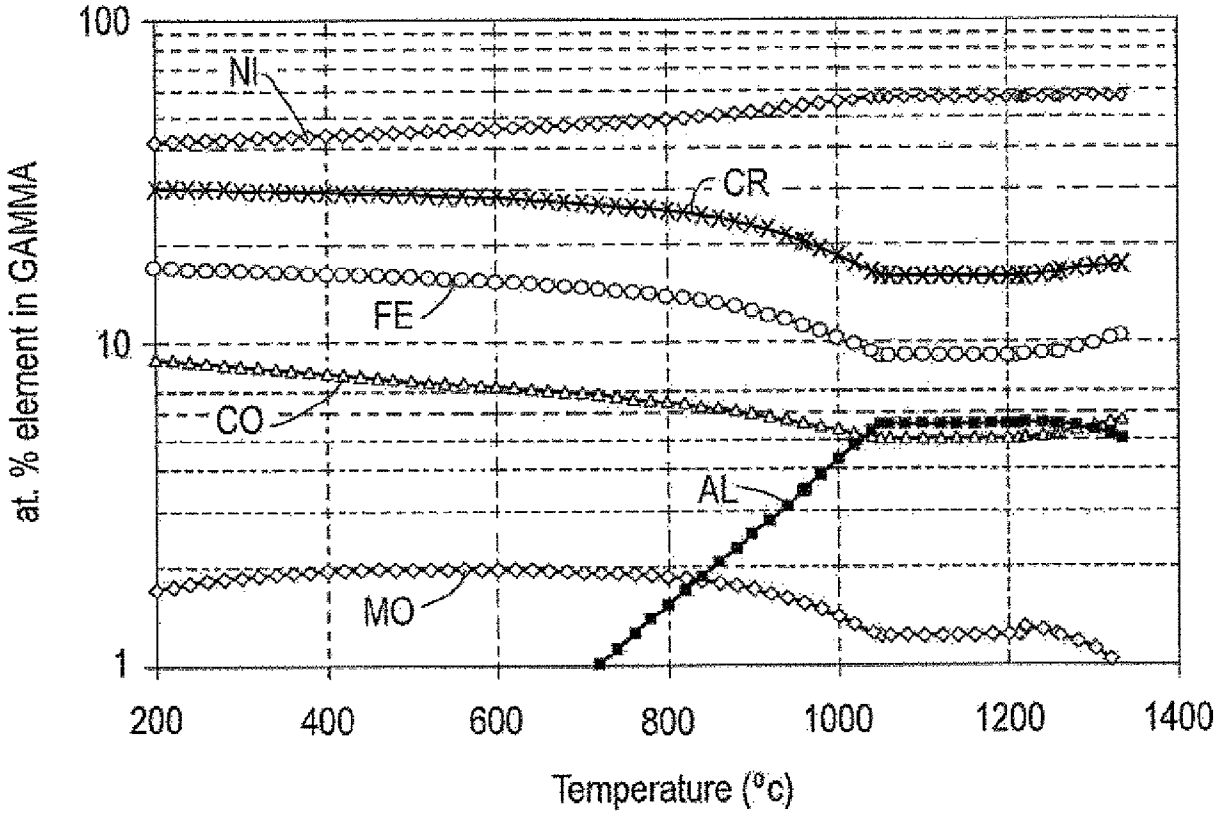
FIG. 3 shows the predicted elemental content in the gamma phase for alloy V207K.

To optimise resistance to hot corrosion and oxidation, a protective chromia scale should form as quickly as possible at temperatures above 500° C. Three features of the composition facilitate this: firstly, to maximise the Cr level in the gamma phase; secondly, to minimise the Co and Fe content in the gamma phase; and thirdly, to minimise the occurrence of rutile ($TiO_2$) by reducing the Ti. To promote the formation of a stable chromia ($Cr_2O_3$) scale, the inventor has determined that at temperatures between 500° C. and 800° C. the Cr level in the gamma phase should be greater than 25 at. %, and that the levels of Co and Fe individually be below 17 at. %. FIG. 3 shows the predicted elemental content in the gamma phase for alloy V207K.

In the alloys defined in Table 2, surface scales will be composed predominantly of Cr and Ti oxides, with smaller amounts of Ni, Fe and Co oxides. The level of Cr that can be added is limited by the propensity for topological close packed (TCP) sigma (a) phase during prolonged high temperature exposure. In alloys V207M, N, O and P, the Cr content of the alloy has been raised from 16 at. % to 19 at. %. This is made possible by reducing the Mo content from 1.35 at. % to 0.35 at. %, which increases coherency strains that arise because the gamma prime phase has a larger lattice parameter than the gamma phase. To increase the Cr level beyond 19 at. % would require further reduction of the Mo content. However, greater differences in lattice parameter between the gamma and gamma prime phases may give rise to greater instabilities in the gamma prime phase, such as discontinuous coarsening. As shown in alloy V207N, Q and R, the size of the gamma prime lattice parameter, and thus the misfit, can be reduced by reducing the Nb content (see Table 4).

Table 4 shows the predicted maximum misfit between the gamma and gamma prime phases calculated at ambient from predictions of lattice parameter for the gamma ($a_\gamma$) and gamma prime ($a_{\gamma'}$) phases. Misfit is defined as $(a_\gamma - a_{\gamma'})/a_\gamma$).

TABLE 4

| Predicted values from JMat Pro | |
|---|---|
| Alloy | Max misfit (%) |
| V207G | 0.30 |
| V207H | 0.35 |
| V207I | 0.29 |
| V207J | 0.28 |
| V207K | 0.37 |
| V207L | 0.29 |
| V207M | 0.45 |
| V207N | 0.29 |
| V207O | 0.41 |
| V207P | 0.37 |
| V207Q | 0.17 |
| V207R | 0.18 |
| 720Li | 0.05 |
| RR1000 | −0.13 |

Figure 4:
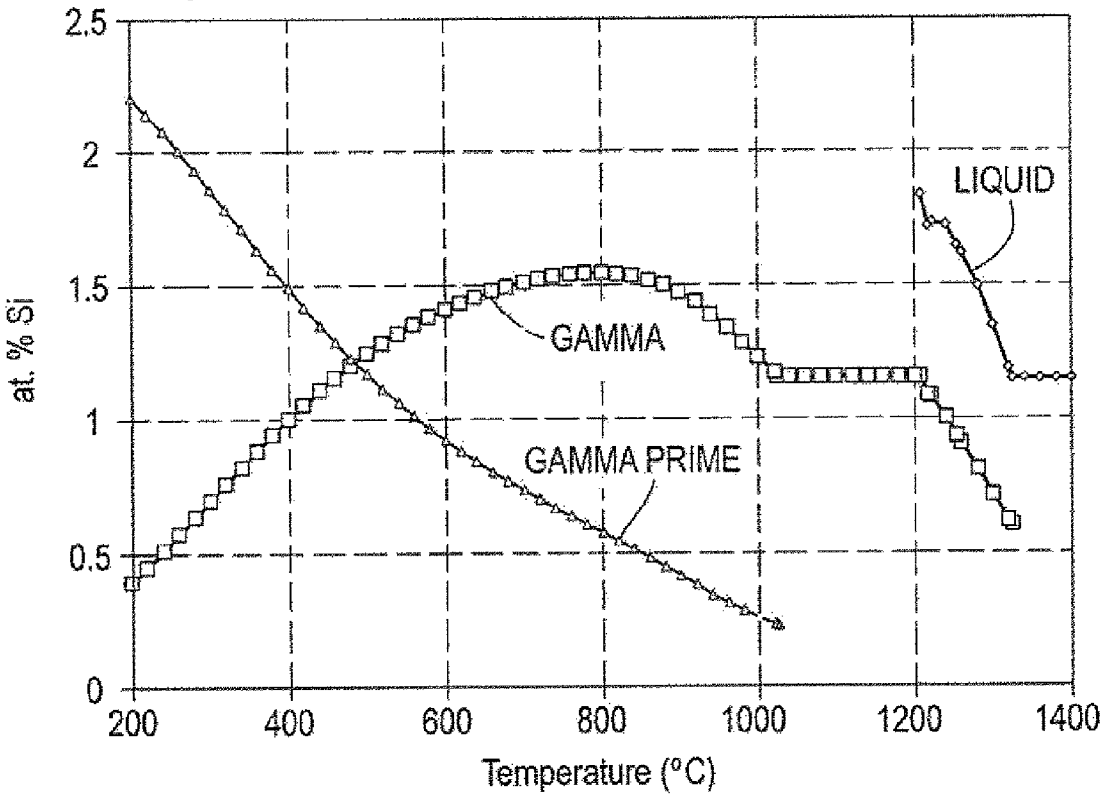
FIG. 4 shows the predicted partitioning of Si in the gamma and gamma prime phases as a function of temperature for the example alloy V207H.
Figure 5:
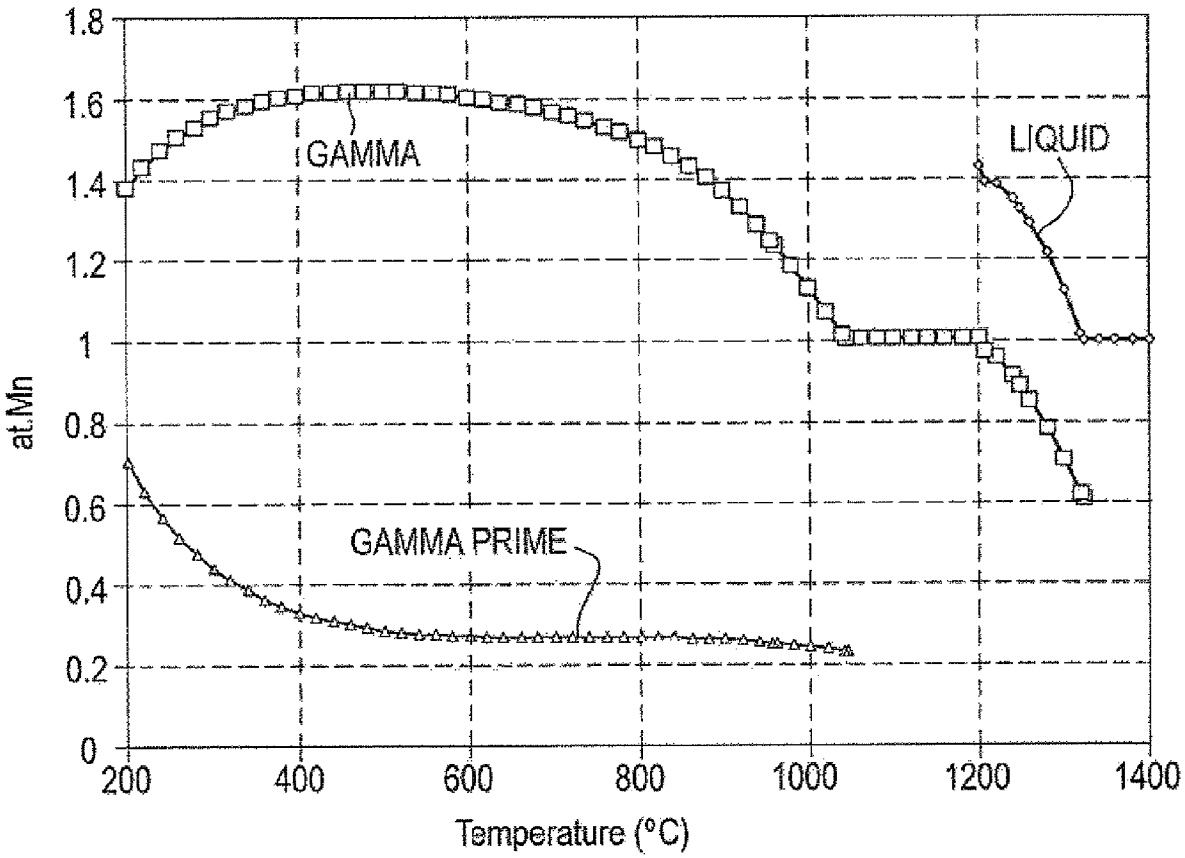
FIG. 5 shows the predicted partitioning of Mn in the gamma and gamma prime phases as a function of temperature for alloy V207J.

Additional improvements can be made to the oxidation and hot corrosion resistance by further promoting chromia scale formation, by adding a sufficient quantity either of Si, to produce a silica ($SiO_2$) film, or of Mn, to produce a spinet ($MnCr_2O_4$) film beneath the chromia scale. It is predicted that Si and Mn partition between the gamma and gamma prime phases, residing predominantly in the gamma phase above 500° C. At such temperatures, nickel alloys begin to show signs of oxidisation damage. FIG. 4 shows the predicted partitioning of Si in the gamma and gamma prime phases as a function of temperature for alloy V207H, and FIG. 5 shows the predicted partitioning of Mn in the gamma and gamma prime phases as a function of temperature for alloy V207J.

Sufficient quantities of Nib and Ta are added to develop stable primary MC carbides (where M can represent Ti, Ta, Nb, or W). Primary carbides based on Ti are not stable and, during prolonged exposure to temperatures above 700° C., decompose to $M_{23}C_6$ and $M_6C$ carbides. These $M_{23}C_6$ and $M_6C$ carbides form as films or elongated particles on grain boundaries and can produce very high rates of intergranular crack growth from high temperature dwell fatigue cycles if continuous carbide films are formed. The mechanism for the intergranular crack growth is considered to be the result of two effects: i) stress assisted oxidation along grain boundaries, and ii) slip and grain boundary movement. It is understood that the formation of $M_{23}C_6$ carbides removes Cr from the gamma phase adjacent to the grain boundary, and therefore reduces the resistance to oxidation in this region. If conditions do not give rise to fatigue cracks, then Cr from near-surface $M_{23}C_6$ carbides can diffuse along grain boundaries towards the surface, leaving voids. These voids are a form of internal oxidation damage that can lead to the development of cracks.

Titanium is beneficial to nickel alloys strengthened by gamma prime as it supplements Al in the ordered $L1_2$ gamma prime particles. However, in addition to forming unstable MC carbides, Ti also gives rise to $TiO_2$ (rutile) nodules that form above $Cr_2O_3$ (chromia) nodules in the surface oxide scale. The source of Ti for the surface rutile nodules is considered to be gamma prime, and with the loss of Al from gamma prime for sub-surface alumina "fingers", a region free of gamma prime is produced during prolonged high temperature exposure. It is considered that this gamma prime free region shows significantly reduced proof strength and primary creep resistance, compared to the base alloy, and is likely to crack under conditions that lead to the accumulation of inelastic strain. To minimise these influences, Ti levels have been minimised or Ti has been removed completely (V207H & I) from the proposed alloys.

These alloys should precipitate less than 1% of topological close packed (TCP) sigma (a) phase after 1000 hours at or below 800° C. This level of sigma phase (containing Cr, Mo, Ni and Co) on grain boundaries, precipitating on $M_{23}C_6$ carbides, removes Cr from the gamma matrix and reduces the resistance of the alloy to dwell crack growth. Predicted time-temperature-transformation (TTT) curves for the alloys indicate that 1% sigma is not precipitated following 1000 hours' exposure to temperatures at or below 800° C. Experimental work on the nickel base alloy RR1000 has indicated that, compared to predicted TTT curves, considerably longer time at temperature is required to precipitate sigma phase.

The resistance of the alloys to creep strain accumulation has been maximised through solid solution strengthening of the gamma phase by W and Mo. However, the total W and Mo levels have been limited to about 5 wt. %, as these elements produce acidic oxides that are detrimental to the resistance of the alloy to Type II hot corrosion damage. As indicated above, imposing this limit prevents the reduction of coherency strains that are produced as a result of the gamma prime phase having a larger lattice parameter than the gamma phase. W in particular increases the lattice parameter of the gamma phase. These tensile strains will contribute to the alloy strength but are not considered to be sufficiently high to influence the stability of the alloy microstructure, for example by causing discontinuous, cellular precipitation of γ'.

Figure 6:
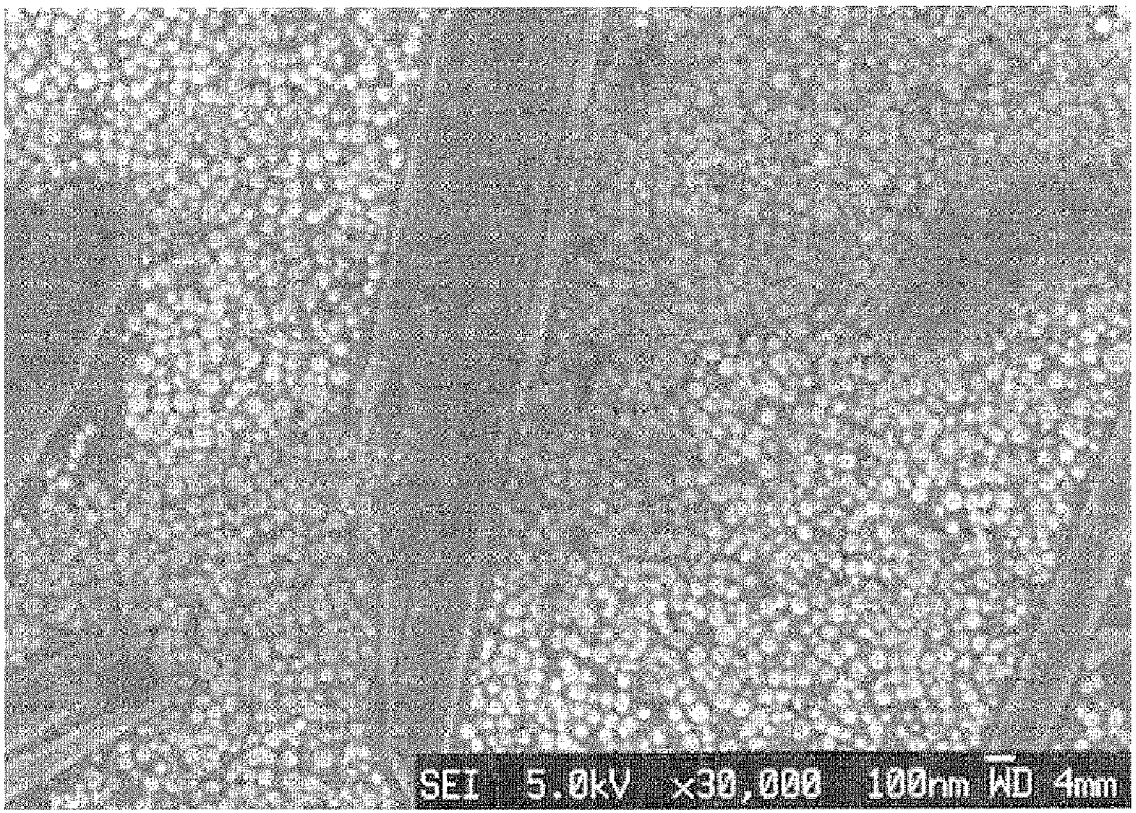
FIG. 6 shows a further secondary electron micrograph of forged V207M.

In alloys V207G to M, O and P, there is an option to precipitate a meta-stable eta-like phase ($Ni_6AlNb$) after heat treatment at temperatures of between 850 and 1050° C. It is understood that this phase is precipitated on grain boundaries, probably as a result of discontinuous, cellular precipitation[1]. This is illustrated in FIG. 6, which shows a secondary electron micrograph of forged V207M after solution and precipitation heat treatments. The solution heat treatment

[1] E. J. Pickering at al, (2012), Grain-boundary precipitation in Allvac 718Plus, *Acta Materialia*, 60, pp. 2757-2769 temperature in this case was within the range to precipitate the meta-stable eta-like phase. The sample was electrolytically etched with 10% phosphoric acid to remove the gamma phase. It is not currently possible to predict this grain boundary precipitation, particularly as retained strain from forging is likely to strongly influence behaviour. However, through forging and heat treatment, the eta-like phase can be precipitated on grain boundaries to act as a barrier to grain boundary oxygen diffusion and to deplete γ' from the grain boundary region. This can promote improved resistance to dwell crack growth. The heat treatment strategy also contributes to this, as will be explained presently. It is also understood that the precipitation of the eta-like phase can be avoided by solution heat treatment at temperatures above 1050° C., quenching and then ageing below 850° C. Alloys V207N, Q and R have been designed to be free of this eta-like phase and delta phase.

and corrosion damage would be inferior. With the levels of S and P specified in Table 2, the resistance to oxidation and corrosion damage will be optimised.

Raw material costs have been minimised by reducing Co content, and by replacing Co with Fe.

TABLE 5

| Element | Logic |
|---|---|
| Cr | Maximise for resistance to oxidation and corrosion resistance. Partitions to gamma phase. Cr level limited by propensity for topological close packed phase (sigma). Need stable primary MC carbide so as not to reduce Cr levels adjacent to grain boundaries as a result of precipitation of $M_{23}C_6$ during high temperature exposure. Therefore MC carbide is mainly Nb, Ta, W with limited or no Ti. Cr also present in $M_3B_2$ borides. |
| Mo | Partitions to gamma prime, solid solution strengthener and produces $M_3B_2$ boride. See logic for B, set to 0.15 at. % B to tie up Mo and reduce propensity for sigma phase. |
| Co | Partitions to gamma phase. Limit Co content to reduce raw material costs and propensity for sigma phase; has a greater contribution to sigma formation than Fe. Co reduces gamma prime solvus temperature. |
| W | Partitions to gamma. Effective solid solution strengthener, more effective than Mo. Increases lattice parameter of gamma phase. Less potent sigma former than Mo. It is a heavy element that has a significant effect on alloy density. |
| Fe | Partitions to gamma phase. Less potent sigma former than Co. Inexpensive element, cheaper than Co. |
| Mn | In sufficient quantities, Mn is beneficial to oxidation resistance. It forms a $MnCr_2O_4$ spinel in Ni—Cr alloys, which acts as a diffusion barrier. Partitions to both gamma and gamma prime but increasingly to gamma at higher temperatures. |
| Si | In sufficient quantities, Si is beneficial to oxidation resistance; silica is a diffusion barrier. Partitions to gamma prime at low temperatures but then moves to gamma at higher temperatures. Minimise to avoid detrimental impact on microstructure stability and mechanical properties. |
| Ti | Recommend that Ti content is minimised as during high temperature exposure in air, Ti readily migrates from gamma prime phase to surface where it oxidises to form rutile ($TiO_2$). Ti is therefore considered to be detrimental to oxidation resistance. TiC is not a stable MC carbide and decomposes to form $M_{23}C_6$. Otherwise partitions to gamma prime. |
| Al | Primary gamma prime former. During high temperature exposure in air, Al migrates from the gamma prime phase to form alumina ($Al_2O_3$) fingers, a form of internal oxidation damage. Limit Al level to enable delta to form. |
| Ta | Stable MC carbide former. Gamma prime former. Considered not to be detrimental to oxidation resistance. Increases lattice parameter of gamma prime. It is a heavy element that has a significant effect on alloy density. |
| Nb | Nb is predominantly a MC carbide and delta former, but also partitions to the gamma prime phase. Beneficial to resistance to oxidation as grain boundary delta phase is a diffusion barrier. Nb is also a "getter" of S. It is a moderately heavy element that has a moderate effect on alloy density. |
| Hf | Hf forms oxides and sulphides. It is beneficial in improving grain boundary strength and thus resistance to dwell crack growth. This may result from the occurrence of fine grain boundary $HfO_2$ particles (<1 μm) that provide barriers to diffusion of oxygen. $HfO_2$ particles/anomalies are produced in melting/partially liquating alloys that contain Hf. These may reduce fatigue performance. Hf is also a MC carbide former but less potent that Nb, Ta or Ti. |
| B | Forms borides that provide high temperature strength and creep resistance. Set B content to 0.15 at % to produce beneficial grain boundary properties (either as boride or as segregate) and to tie up Mo and reduce propensity for sigma phase. See Mo logic. Further B is not considered to be beneficial. |
| C | Forms carbides that provide high temperature strength and creep resistance. Controls grain growth (by pinning grain boundaries) during supersolvus heat treatment. Limit C content as it ties up Nb, Ta and W and does not produce significant benefits in high temperature and grain boundary strength. |
| Zr | De-oxidiser, forms oxides and sulphides, resides at grain boundaries. Grain boundary strengthener. No benefit above 0.055 wt. %. |
| Mg | De-oxidiser, forms oxides and sulphides, resides at grain boundaries. Grain boundary strengthener. |

Figure 7:
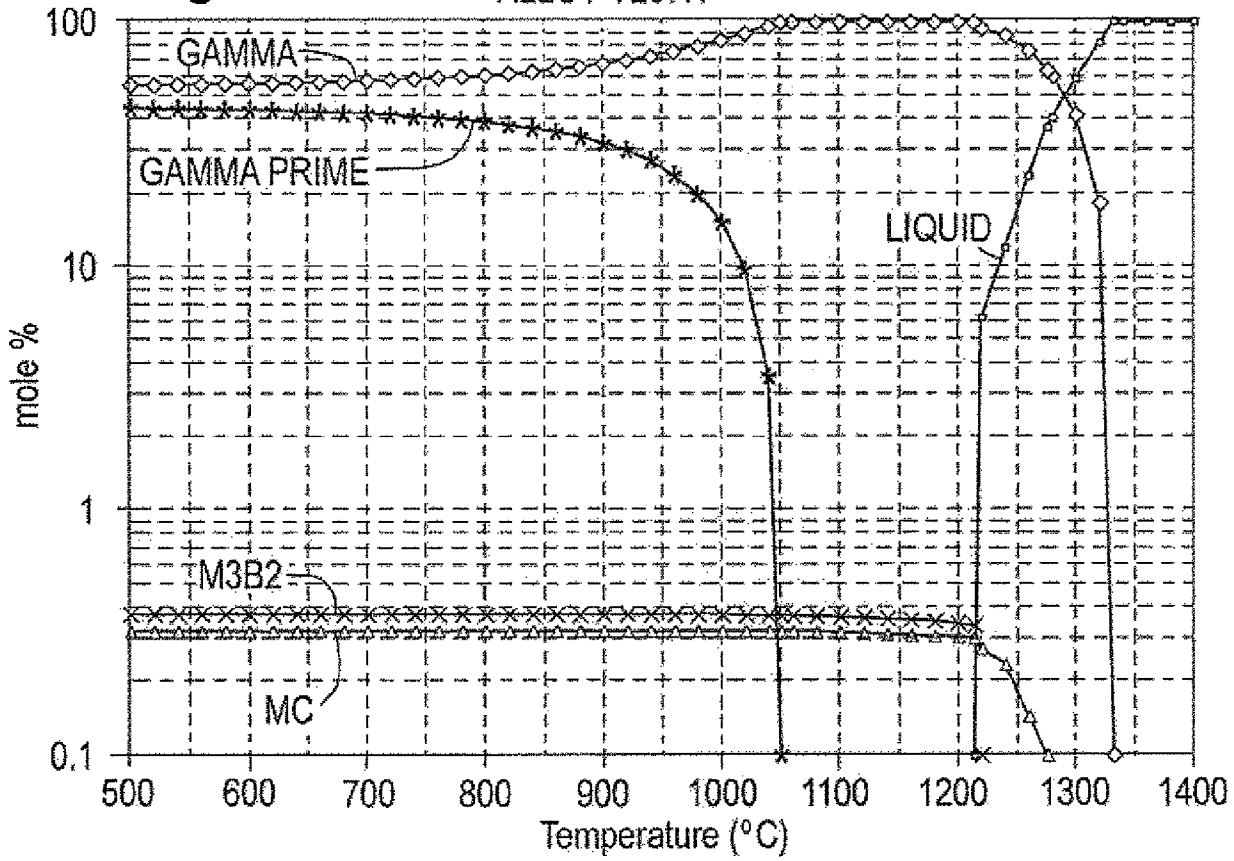
FIG. 7 shows the predicted phase equilibrium for alloy V207K.

To achieve this, the Nb content was reduced to 1.75 at. %. In these compositions, Nb forms MC carbides and partitions to the gamma prime phase. The predicted phase equilibrium for alloy V207K is shown in FIG. 7.

Although not included in any of the disclosed example compositions, it may be desirable in some circumstances to include up to 0.5 wt. % Hf in the composition of an alloy according to the invention. Hafnium is known to improve the grain boundary strength and dwell crack growth resistance of nickel base disc alloys. However, melt anomalies are produced in melting alloys that contain Hf. These anomalies would need to be managed, and the occurrence of them would need to be balanced against the likely benefits for a particular alloy.

Levels of trace elements S and P have been minimised to promote good mechanical integrity of oxide scales. It is expected that this will enhance the resistance to oxidation and hot corrosion damage. It is expected that levels lower than those specified in Table 2 will be achievable in large production size batches of material. It is anticipated that the benefits of the invention would still be achievable provided the level of S is less than 50 ppm, and of P less than 50 ppm, although in these circumstances the resistance of the alloys to oxidation The effects of the different elemental additions on the alloys' behaviour is summarised in Table 5. The proposed alloy compositions were defined based on this understanding of the effects of elemental additions.

It is envisaged that alloys according to the invention will be produced using powder metallurgy technology, such that small powder particles (<53 μm in size) from inert gas atomisation are consolidated in a stainless steel container using hot isostatic pressing and then extruded to produce fine grain size billet. Increments would be cut from these billets and forged, preferably, at low strain rates under isothermal conditions. Appropriate forging temperatures, strains and strain rates would be used to achieve the preferred average grain size of ASTM 9 to 7 (16-32 μm) following solution heat treatment above the gamma prime solvus temperature.

It will be appreciated that other billet and forging technology could alternatively be used to produce raw material for disc rotors. The applicability of alternative techniques, such as cast and wrought processing, i.e. conversion of triple melted ingot, and conventional press forging would depend on the level of success in achieving (i) a consistently homogeneous ingot chemistry with acceptable amounts of melt anomalies, (ii) a sufficiently large forging window and crack-free forgings, and (iii) control of grain growth to produce a narrow grain size distribution in heat treated forgings.

To generate the required balance of properties in the alloys according to the invention, it is also necessary to undertake the following heat treatment steps:

1. The preferred route is to solution heat treat the forging above the gamma prime solvus temperature for sufficient time to grow the grain size to the required average grain size of ASTM 9 to 7 (16-32 μm) throughout. Appropriate forging conditions and levels of deformation will be used to control grain growth, particularly to prevent isolated grains from growing to sizes greater than ASTM 2 (180 μm).
2. For alloys G to K, M, O and P, there is an option to undertake a second heat treatment at a temperature below 1050° C. to precipitate the eta-like phase at grain boundaries.
3. Quench the forging from the solution heat treatment temperature to room temperature using forced or fan air cooling, polymer or oil quenching.
4. Undertake a precipitation and stress relief heat treatment at a temperature between 830° C. and 850° C. for 4-16 hours, then air cool. This heat treatment is required to i) relieve residual stresses from quenching; and ii) grow gamma prime particles.

It is envisaged that the precipitation and stress relief heat treatment will promote reduced rates of crack growth from dwell cycles by reducing the amount of tertiary gamma prime adjacent to the grain boundary region, which will reduce the local creep strain resistance and will allow relaxation of stresses in the material ahead of a fatigue crack. The heat treatment will also coarsen the tertiary gamma prime such that further coarsening during service exposure will be insignificant and will not reduce mechanical properties.

The proposed alloys are expected to show the following material properties compared with the existing nickel alloy RR1000, and taking account of differences in density (8.21 $g \cdot cm^{-3}$ for RR1000; 8.34-8.46 $g \cdot cm^{-3}$ for V207G to M, O and P; and 8.22-8.25 $g \cdot cm^{-3}$ for V207N, Q and R at ambient temperature).

Improved resistance to oxidation and hot corrosion damage at temperatures of 650-800° C.; improved tensile proof strength at temperatures of 20-800° C. for an alloy with an average grain size of ASTM 9-7 (16-32 μm); improved resistance to creep strain accumulation at temperatures of 650-800° C.; dwell crack growth resistance equivalent to coarse grain RR1000 at temperatures above 600° C.; improved dwell fatigue endurance behaviour at temperatures above 600° C.; similar or improved fatigue endurance behaviour at temperatures below 600° C. for an alloy with an average grain size of ASTM 9-7 (16-32 μm); improved microstructural stability during high temperature exposure (e.g. 1000 hours at 800° C.); reduced levels of residual stress in forgings after heat treatment (this will minimise distortion during component manufacture); reduced billet costs (i.e. raw material costs).

It is expected that the time to develop a life-limiting depth of hot corrosion and oxidation damage will be twice that of existing alloys such as 720Li and RR1000 at temperatures between 650° C. and 800° C.

The invention therefore provides a range of nickel base alloys particularly suitable to produce forgings for disc rotor applications. Components manufactured from these alloys will have a balance of material properties that will allow them to be used at significantly higher temperatures. In contrast to known alloys, the alloys according to the invention achieve a better balance between resistance to environmental degradation and high temperature mechanical properties such as proof strength, resistance to creep strain accumulation, dwell fatigue and damage tolerance. This permits the alloys according to the invention to be used for components operating at temperatures up to 800° C., in contrast to known alloys which are limited to temperatures of 700-750° C.

These improved properties are achieved by i) definition of compositions; ii) the process routes for billet and forgings; and iii) the heat treatment of the forgings. In terms of the composition, particular attention has been given to i) maximising Cr content to promote the formation of chromia scale as quickly as possible during exposure to high temperatures; ii) minimising elements that are considered detrimental to oxidation and hot corrosion resistance; and iii) the development of diffusion barriers to grain boundary oxidation. Such barriers include the precipitation of eta-like phase at grain boundaries and the promotion of stable $Cr_2O_3$ scales through the formation of $SiO_2$ and $MnCr_2O_4$ films.

Although the alloys according to the invention are particularly suitable for disc rotor applications in gas turbine engines, it will be appreciated that they may also be used in other applications. Within the field of gas turbines, for example, it is envisaged that they would be especially suitable for use in combustor or turbine casings, which would benefit from the expected improvements in material properties, notably the improved proof strength and resistance to creep strain accumulation. As compressor discharge temperatures and turbine entry temperatures increase over time, to promote improvements in thermal efficiency and thereby in fuel consumption, the temperature of the static components of the combustor and turbine will necessarily also increase. Such components could be produced by conventional cast and wrought processes (i.e. from forgings) or by powder metallurgy. The latter is preferred, given the highly alloyed compositions and the ability to produce compacts that are close to the component geometry, thereby reducing the amount of material required and the time required to machine the component.

The invention claimed is:

1. A nickel-base alloy having the following composition (in weight percent unless otherwise stated):

Cr 13.8-14.7; Co 3.5-4.6; Fe 8.0-9.2; Si 0.5-0.6; Mn 0.0-0.95; Mo 2.1-2.3; W 2.7-3.0; Al 2.2-2.8; Nb 5.4-5.7; Ti 0.00-0.85; Ta 1.95-3.25; Hf 0.0-0.5; C 0.01-0.05; B 0.02-0.04; Zr 0.04-0.06; Mg 0.015-0.025; S<50 ppm; P<50 ppm; the balance being Ni and incidental impurities.

2. A nickel-base alloy having the following composition (in weight percent unless otherwise stated):

Cr 13.7-14.4; Co 3.5-4.5; Fe 8.0-9.0; Si 0.0-0.6; Mn 0.85-0.95; Mo 2.1-2.3; W 2.7-2.9; Al 2.4-2.9; Nb 5.4-5.6; Ti 0.00-0.85; Ta 1.95-3.15; Hf 0.0-0.5; C 0.01-0.05; B 0.02-0.04; Zr 0.04-0.06; Mg 0.015-0.025; S<50 ppm; P<50 ppm; the balance being Ni and incidental impurities.

3. A nickel-base alloy having the following composition (in weight percent unless otherwise stated):

Cr 13.8-14.4; Co 4.5-5.5; Fe 8.0-9.0; Si 0.0-0.6; Mn 0.0-0.95; Mo 2.1-2.3; W 2.7-2.9; Al 2.4-2.6; Nb 5.4-5.6; Ti 0.75-0.85; Ta 1.95-2.25; Hf 0.0-0.5; C 0.01-0.05; B 0.02-0.04; Zr 0.04-0.06; Mg 0.015-0.025; S<50 ppm; P<50 ppm; the balance being Ni and incidental impurities.

4. A nickel-base alloy having the following composition (in weight percent unless otherwise stated):

Cr 13.9-14.5; Co 3.5-4.5; Fe 8.1-9.1; Si 0.0-0.6; Mn 0.0-0.95; Mo 2.1-2.3; W 2.7-2.9; Al 2.4-2.6; Nb 7.0-7.2; Ti 0.75-0.85; Ta 0.0-3.25; Hf 0.0-0.5; C 0.01-0.05; B 0.02-0.04; Zr 0.04-0.06; Mg 0.015-0.025; S<50 ppm; P<50 ppm; the balance being Ni and incidental impurities.

5. A nickel-base alloy having the following composition (in weight percent unless otherwise stated):

Cr 16.2-17.2; Co 2.5-4.5; Fe 8.1-9.1; Si 0.0-0.6; Mn 0.00-0.95; Mo 0.5-0.7; W 2.7-2.9; Al 2.2-2.6; Nb 5.4-5.6; Ti 0.75-0.85; Ta 2.05-2.35; Hf 0.0-0.5; C 0.01-0.05; B 0.02-0.04; Zr 0.04-0.06; Mg 0.015-0.025; S<50 ppm; P<50 ppm; the balance being Ni and incidental impurities.

6. A nickel-base alloy having the following composition (in weight percent unless otherwise stated):

Cr 16.9-17.5; Co 2.6-5.6; Fe 8.3-9.3; Si 0.0-0.6; Mn 0.00-0.95; Mo 0.5-0.7; W 2.8-3.0; Al 2.2-3.5; Nb 2.7-2.9; Ti 0.75-0.85; Ta 2.05-2.35; Hf 0.0-0.5; C 0.01-0.05; B 0.02-0.04; Zr 0.04-0.06; Mg 0.015-0.025; S<50 ppm; P<50 ppm; the balance being Ni and incidental impurities.

* * * * *